US008857127B2

(12) United States Patent
Windmöller

(10) Patent No.: US 8,857,127 B2
(45) **Date of Patent: *Oct. 14, 2014**

(54) FLOOR COVERING

(71) Applicant: Ulrich Windmöller Consulting GmbH, Schloss Holte-Stukenbrock (DE)

(72) Inventor: Ulrich Windmöller, Schloss Holte-Stukenbrock (DE)

(73) Assignee: Ulrich Windmöller Consulting GmbH, Schloss Holte-Stukenbrock (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/177,937

(22) Filed: Feb. 11, 2014

(65) Prior Publication Data

US 2014/0157695 A1 Jun. 12, 2014

Related U.S. Application Data

(63) Continuation of application No. 13/659,446, filed on Oct. 24, 2012, now Pat. No. 8,689,513.

(30) Foreign Application Priority Data

Oct. 28, 2011 (EP) ..... 11008659

(51) Int. Cl.
*E04B 2/00* (2006.01)
*E04F 15/02* (2006.01)

(52) U.S. Cl.
CPC ..... *E04F 15/02172* (2013.01); *E04F 15/02038* (2013.01); *E04F 15/02* (2013.01)
USPC ..... 52/588.1; 52/589.1; 52/309.16

(58) Field of Classification Search
USPC ..... 52/588.1, 589, 1, 586.1, 590.2, 309.16, 52/403.1, 309.15
See application file for complete search history.

(56) References Cited

U.S. PATENT DOCUMENTS

| | | | | |
|---|---|---|---|---|
| 3,204,380 | A * | 9/1965 | Wilson et al. | 52/309.15 |
| 5,755,068 | A | 5/1998 | Ormiston | |
| 6,332,733 | B1 * | 12/2001 | Hamberger et al. | 403/329 |
| 6,363,677 | B1 | 4/2002 | Chen et al. | |
| 6,786,019 | B2 | 9/2004 | Thiers | |
| 8,261,504 | B2 | 9/2012 | Hakansson | |
| 2004/0182036 | A1 | 9/2004 | Sjoberg et al. | |
| 2006/0099386 | A1 * | 5/2006 | Smith | 428/151 |
| 2007/0175144 | A1 | 8/2007 | Hakansson | |
| 2007/0175148 | A1 * | 8/2007 | Bergelin et al. | 52/480 |
| 2008/0000179 | A1 | 1/2008 | Pervan | |

FOREIGN PATENT DOCUMENTS

WO 2008053333 A2 5/2008

* cited by examiner

*Primary Examiner* — Basil Katcheves
(74) *Attorney, Agent, or Firm* — Richard M. Goldberg

(57) ABSTRACT

Floor covering (10) including panels (12,14; 112) having a core (24) of a plastic material and at least one cover layer (28,30) covering the upper side of the core, the panels being provided with complementary and mutually engaging locking profiles (20,22; 120) at their connected lateral edges (16, 18). For forming a groove between two connected panels (12,14; 112) at least one of these panels is provided with a milled-out portion (60,160) at the upper side of its lateral edge, with the cover layer (28,30) excavated completely over the width of the milled-out portion (60,160) so that the bottom (62,162) of the milled-out portion (60,160) is formed by the material of the core.

3 Claims, 4 Drawing Sheets

FLOOR COVERING

BACKGROUND OF THE INVENTION

The present invention relates to a floor covering that includes panels having a core of a plastic material and at least one cover layer covering the upper side of the core, with the panels being provided with complementary and mutually engaging locking profiles at their connected lateral edges.

Floor coverings of the above kind exist in a large variety of embodiments. For example, panels with a core of wood material like MDF or HDF are very common. On top of the core there is usually a decor layer showing the appearance of wood. This decor layer is in turn covered by a transparent wear layer that is resistant against wear and may consist of a plastic material or a resin. The bottom side of the panel is formed by a back pull layer to prevent a deformation of the panel body.

Moreover, floor panels comprising a core of a plastic material like PU (Polyurethane) or PVC (Polyvinylchloride) are recently available. Compared to panels of wood materials, these panels provide the advantage of a higher elasticity and improved characteristics in use, for example, with respect to sound dampening. Usually these panels of plastic materials comprise at their upper sides at least one cover layer that covers the upper side of the core. The connection between two panels is usually provided by locking profiles at their lateral edges that are shaped complementary to each other and that engage with each other according to a tongue and groove connection. This means that adjacent panels can be held together in a way that their upper sides join tightly and without forming spaces between each other.

The market recently demands an embodiment of panels with a tile-like appearance, with the panels divided visually by grooves. For this purpose a groove appearance was printed onto the upper side of the panel and formed as a depression by pressing so that the groove is also haptically perceivable. However, this processing does not always lead to satisfying results. First of all, wider and deeper grooves with a realistic appearance cannot be reproduced with the above described processing. It is desired to provide a floor covering that imitates tiles divided by grooves by means of the above mentioned panels with a core of a plastic material.

SUMMARY OF THE INVENTION

It is therefore an object of the present invention to provide a floor covering of panels with a core of a plastic material that imitates a tile appearance with grooves more realistic as it is possible with the common techniques. It is another object of the present invention to imitate the groove optics in a most efficient way without additional processing steps like printing or pressing.

According to the present invention, these objects are achieved by a floor covering comprising the features of claim 1.

According to the present invention, these objects are achieved by a floor covering with at least one panel including a milled-out portion at an upper side of a lateral edge thereof, with the cover layer thereat being excavated completely over a width of the milled-out portion so that a bottom of the milled-out portion is formed by the material of the core, such that a groove is formed between two connected panels.

This groove can be formed by milling much deeper than with the known pressing methods. Moreover, the contrast between the core material on the bottom of the milled-out portion and the adjacent cover layer forming the surface of the tile can contribute to the realistic appearance. In particular the cover layer may be represented by a decor layer that is covered by a wear resistant transparent wear layer, as mentioned above. The shape of the milled-out portion can imitate the haptic impression of the groove, as desired.

The groove according to the present invention can be formed by a milling tool at the lateral edge without weakening the locking profile. In particular it is possible to form the locking profile and the milled-out portion for the groove in one single processing step, for example, using a combination tool.

According to one preferred embodiment of the present invention, the bottom of the milled-out portion forms a horizontal bottom of the groove.

More preferably, the groove comprises a mainly rectangular cross section with approximately vertical sidewalls.

According to another preferred embodiment of the present invention, the upper edges of the sidewalls of the groove are provided with bevels. The bevels form slanted surfaces to avoid a sharp transition from the upper side of the panel to the groove.

According to another preferred embodiment, the bottom of the groove is sealed by a seal covering. The seal covering can be water-repellent to avoid a penetration of water into the core of the panel. Moreover, the seal covering can be dirt repellent. If the seal covering is transparent, the bottom of the groove is still visible. If desired, the seal covering can be coloured to provide a contrast to the decor layer.

According to the present invention, a method for forming a panel of the floor covering of the above kind is characterised in that the locking profile at the lateral edge as well as the milled-out portion provided thereon are formed by milling, and the locking profile and the milled-out portion are formed in one single processing step.

According to a preferred embodiment of this method, the bevel at the milled-out portion is formed together with the locking profile and the milled-out portion in one single processing step.

BRIEF DESCRIPTION OF THE DRAWINGS

Preferred embodiments of the present invention are explained in the following with respect to the enclosed figures, as described below.

DETAILED DESCRIPTION

Figure 1:
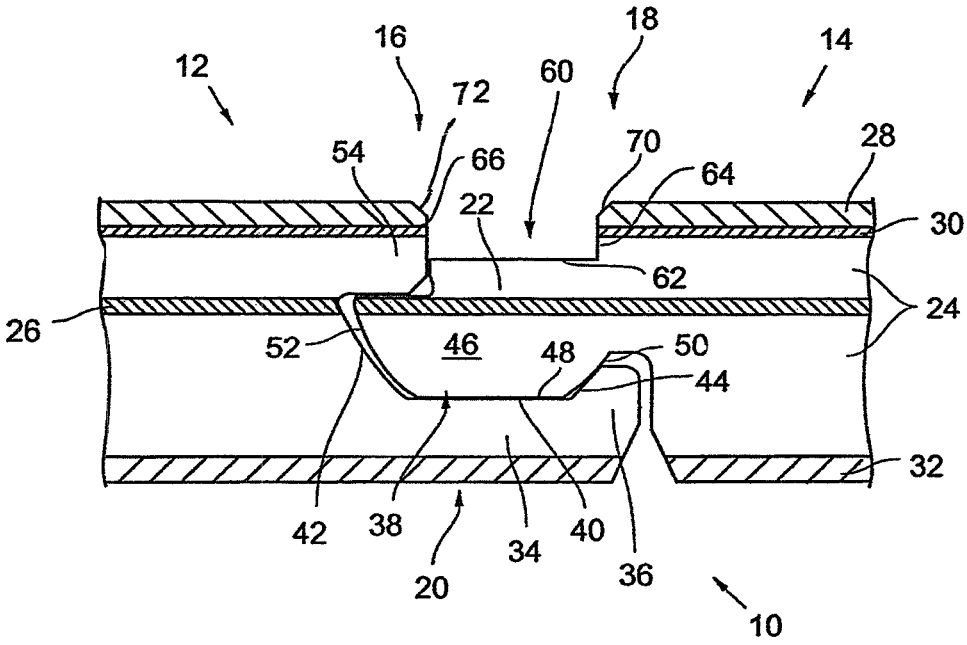
FIG. 1 is a schematic lateral section through the floor covering according to a first embodiment of the present invention, comprising two connected floor panels.

The floor covering 10 shown in FIG. 1 consists of a number of adjacent panels, from which two panels, namely a left panel 12 and a right panel 14 are shown in FIG. 1 in a connected state. The two panels 12, 14 are both provided at their connected lateral edges 16, 18 with mutually engaging form-locking profiles 20, 22, that will be further described in the following. The engagement of these locking profiles 20, 22 prevents the panels 12, 14 from drifting away from each other.

The panels 12, 14 of the floor covering 10 have the same laminate structure and comprise respectively one core 24 made of a plastic material, like polyurethane (PU) or polyvinyl-chloride (PVC). As usual, this core 24 also comprises filling materials. Because of the material characteristics of the used plastic materials, it also comprises a certain flexibility. For providing a dimensional stability of the core 24, a glass fibre mat 26 is present in the upper portion of its centre that extends horizontally through the core 24.

The upper side of the core 24 is covered by two covering layers. These are an upper wear layer 28 made of a wear resistant transparent plastic material, and a decor layer 30 beneath the wear layer 28 formed by a printed decor film representing a wood or tile appearance. Because of the transparency of the wear layer 28, the decor on the upper side of the panels 12, 14 is still visible.

At the bottom of the panels 12, 14, the core 24 can be provided with a back-pull layer 32 that prevents a deformation of the panels 12, 14.

The laminate structure of the panels 12, 14, comprising a wear layer 28, a decor layer 30, a core 24 comprising a glass fibre mat 26, and a back-pull layer 32, is known as such and does not represent a subject of the present invention.

This is also valid for the mutually engaging locking profiles 20, 22 that are fitted together as a tongue and groove connection. The left panel 12 comprises at its lateral edge 16 a female profile 20 with a lower horizontal protrusion 34 that is generally trough shaped and is provided at its outer edge 36 facing the right panel with 14 an elevated web that delimits a receiving portion 38 on the protrusion 34 with a flat horizontal bottom 40 and slanted and slightly concave outer walls 42, 44.

This receiving portion 38 receives the protrusion 46 of the complementary profile 22 of the right panel 14. This protrusion 46 has a generally trapezoid cross section, comprising a flat horizontal bottom 48 to support onto the bottom 40 of the receiving portion 38, and slanted convex sidewalls 50, 52 with a shape mainly corresponding the sidewalls 42, 44 of the receiving portion 38. Within a step portion at the upper side of the protrusion 46, a complementary protrusion 54 at the upper side of the lateral edge 16 of the left panel 12 is received. This protrusion 54 delimits the receiving portion 38 partially in the upper direction, and in the connected state of the panels 12, 14 it rests partially onto the protrusion 46 of the right panel 14.

The right panel 14 is provided on its upper side at its outer edge 18 facing the right panel 12 with a milled-out portion 60. This milled-out portion 60 has a flat, horizontal bottom 62 and a vertical sidewall 64 on its side facing the right panel 14. As a whole, the milled-out portion 60 has generally rectangular cross section, as can be taken from FIG. 1. The milled-out portion 60 is deeper than the thickness of the wear layer 28 and the decor layer 30, in a way that the wear layer 28 and the decor layer 30 are excavated completely over the whole width of the milled-out portion 60 beginning from the lateral edge 18 of the right panel 14 so that the material of the core 24 is exposed. As a consequence, the core 24 is visible at the upper side of the panel 14 within the groove and forms a clear contrast to the complete remaining surface of the panels 12, 14 that is covered by the decor layer 30 and the wear layer 28.

In the connected state of the panels 12, 14, the protrusion 54 of the left panel 12 is directly adjacent to the milled-out portion 60 and delimits this milled-out portion 60 in a lateral direction, so that the flat vertical outer side 66 of the protrusion 54 forms a vertical wall that delimits a groove with a rectangular cross section, together with the opposed wall 64 of the right panel 14 and the bottom 62. This groove forms a groove at the upper side of the panels 12, 14 between the surface portions of these panels. By providing the milled-out portion 60, the groove is provided between the panels 12, 14 without printing or pressing the upper sides of the panels 12, 14. Moreover, the impression of a groove is emphasised by the contrast of the different materials of the core 24 at the bottom 62 of the groove and the decor layer 30. For example, the material of the core 24 can have a similar colour as a sealing material of the wear grouting between stone tiles. Together with a stone decor of a wear layer 30, a realistic impression of a floor covering of floor tiles is created. Because of its depth, the groove can easily be perceived haptically.

To prevent the penetration of water into the groove or into the material of the core 24, the milled-out portion 60 can be sealed by a seal covering at its bottom 62 that is shown in the figures. This seal covering can further be dirt repellent or be coloured.

Figure 2:
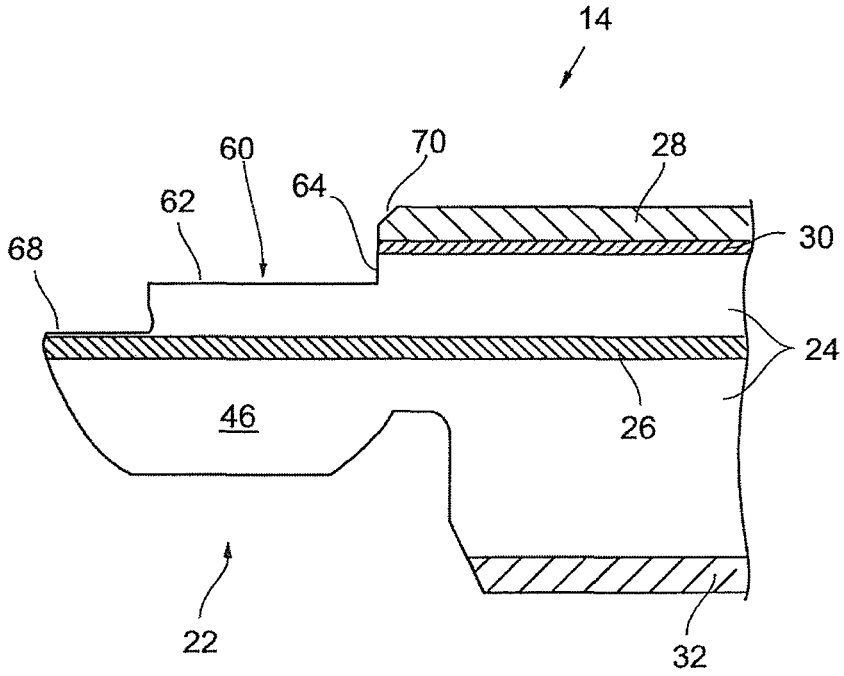
FIG. 2 is a detailed view of the right panel of FIG. 1.

To show the shape of the milled-out portion 60 for forming the groove, the right panel 14 in FIG. 1 is shown in a free state in FIG. 2. The rectangular shape of the milled-out portion 60 can be seen clearly, which is located above the protrusion 46. While this protrusion 46 comprises a stepped portion 68 at its upper outer lateral edge facing the adjacent panel 12, the milled-out portion 60 forms another stepped portion on a higher level that stays exposed in the connected state of the panels 12, 14, as can be taken clearly from FIG. 1.

Figure 3:
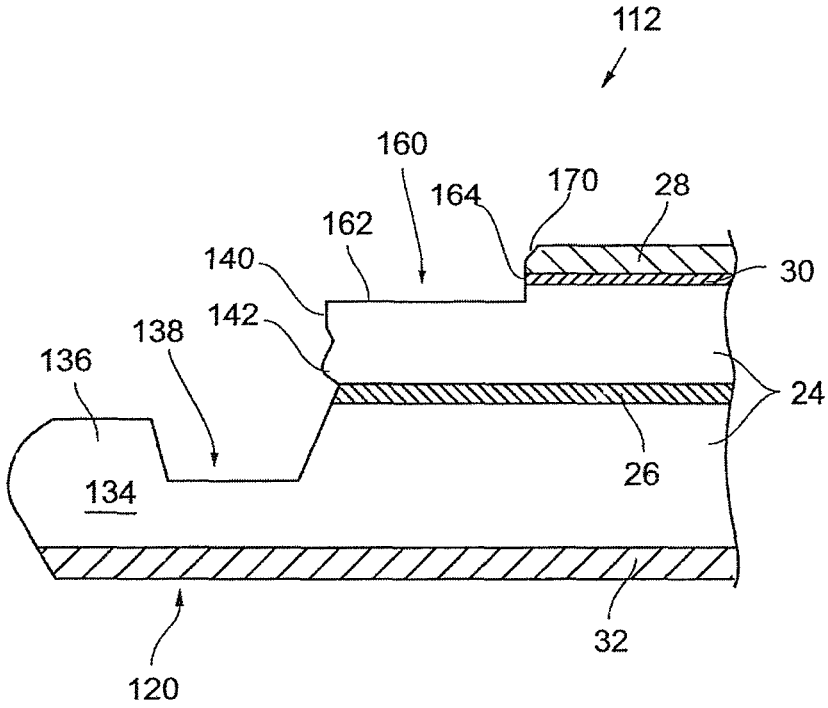
FIG. 3 is a schematic lateral section through a panel of a floor covering according to another embodiment of the present invention.

FIG. 3 shows another panel 112 provided with a different locking profile. This locking profile 120 comprises, similar as the locking profile 20 of the left panel 12 in FIG. 1, a lower protrusion 134 that comprises a trough shaped receiving portion 138 on its upper side. This receiving portion 138 has a generally trapezoid shaped cross section and is delimited towards the end of the protrusion 134 by an elevated portion 136. Above the receiving portion 138 there is an upper lateral edge portion 140 that is generally vertical and comprises a flexible detent 142 that is angled relative to vertical to engage with a profile of complementary shape, that is not shown in FIG. 3. This locking profile 120 is provided for receiving a complementary locking profile that is depressed in a vertical direction into the receiving portion 138. This profile cross section is also known for itself.

At the upper side of the lateral edge portion 140 of the panel 112 there is a milled-out portion 160 with a rectangular cross section, corresponding to the milled-out portion 60 in the panel 14 of FIG. 1. This milled-out portion 160 also comprises a horizontal flat bottom 162 and a vertical sidewall 164 at the side of the milled-out portion 160. In the state connected with another panel that delimits the milled-out portion 160 towards the other side, the milled-out portion 160 forms a groove with a rectangular cross section. The milled-out portion 160 also extends down to a depth below the decor layer 30 so that the bottom of the groove is formed by the material of the core 24. In the connected state, the impression of the groove that is formed that way is the same as described in connection with FIG. 1.

According to FIGS. 1 to 3, the upper edges of the sidewalls 64 and 164 of the milled-out portions 60 and 160 are respectively provided with slanted portions, i.e. with bevels 70, 170. This means that sharp edges at the rims of the milled-out portions 60, 160 are prevented. In FIG. 1, the upper edge of the sidewall 66 at the protrusion 54 of the left panel also comprises such a bevel 72.

Together with the locking profiles 22, 120, the milled-out portions 60, 160 can be formed in one single processing step, for example, by a combination tool that mills the locking profile 22, 120 and the milled-out portions 60, 160 at the same time. This means that an additional processing step is eliminated. Moreover, the bevels 70, 170 can formed at the same time together with the locking profiles 22, 120 and the milled-out portions 60, 160.

Figure 4:
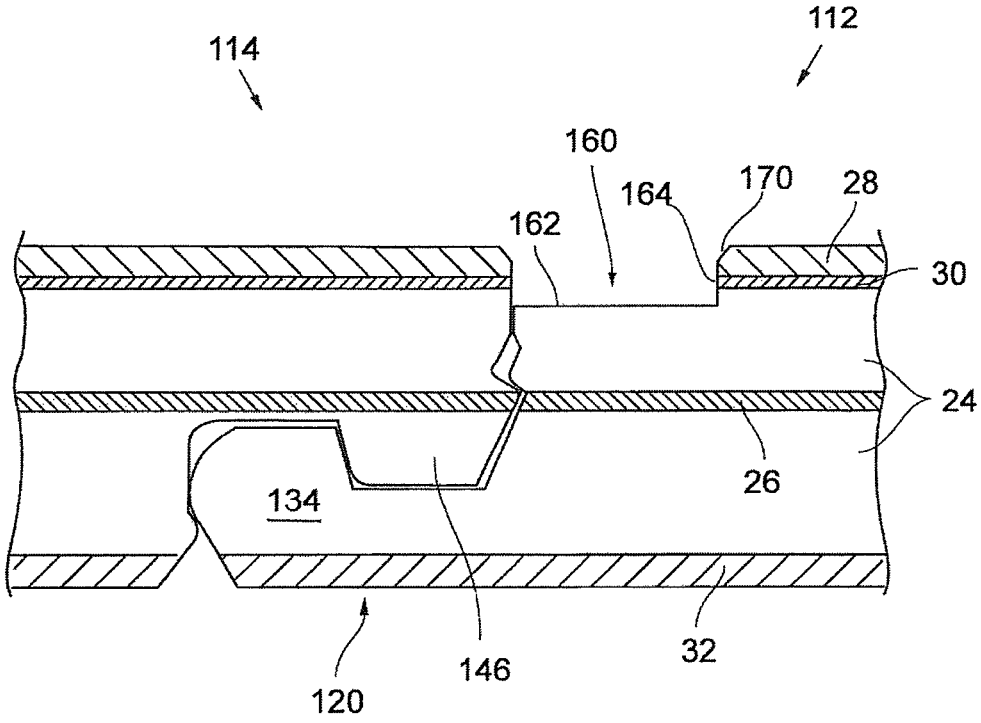
FIG. 4 is another schematic lateral section through a floor covering according to the embodiment of FIG. 3, showing two connected panels.

FIG. 4 shows the panel 112 from FIG. 3 in a state connected with another panel 114. The locking profile 120 of the panel 112 is engaged with a complementary locking profile of the panel 114 in this case. For this purpose the panel 114 is provided with a protrusion 146 facing in a downward direction at its lateral edge facing the panel 112, said protrusion 146 being received by the receiving portion 138. As in the arrangement of FIG. 1, the milled-out portion 160 forms a groove with a rectangular cross section and is delimited laterally by the sidewalls at the upper edges of the panels 112, 114.

What is claimed is:

1. Floor covering comprising panels, each panel comprising:

a core of polyvinylchloride (PVC), said core comprising filling materials, a glass fiber mat provided in an upper portion of a center of the core and extending horizontally through the core, two cover layers on an upper side of the core, comprised of:

an upper wear layer made of a wear resistant transparent plastic material, and a décor layer beneath the wear layer formed by a printed décor film, complementary and mutually engaging locking profiles at connected lateral edges thereof, the lateral edge of one of said locking profiles including a lower protrusion that comprises a trough-shaped receiving portion on an upper side thereof, said receiving portion having a generally trapezoid shaped cross-section and being delimited towards an end of the protrusion by an elevated portion, and above the receiving portion, an upper lateral edge portion being generally vertical and comprising a flexible detent that is angled relative to vertical, the lateral edge of the other locking profile being provided with a protrusion facing in a downward direction at the lateral edge thereof adapted to be received within the receiving portion of the one said locking profile by being depressed in a vertical direction into the receiving portion, the other said locking profile including a depression shaped complementary to said angled flexible detent for engagement therewith, wherein at least one of said panels includes a milled-out portion at an upper side of a lateral edge thereof, with the cover layers thereat being excavated completely over a width of the milled-out portion so that a bottom of the milled-out portion is formed by the material of the core, such that a groove with a rectangular cross section and approximately vertical sidewalls is formed between the two said connected panels, being delimited laterally by the sidewalls of upper edges of the said connected panels.

2. Floor covering according to claim 1, wherein the groove has sidewalls with upper edges and bevels provided at the upper edges.

3. Floor covering according to claim 1, wherein a bottom of the groove is sealed by a seal covering.

* * * * *